United States Patent [19]

Beyersdorf

[11] 4,213,046

[45] Jul. 15, 1980

[54] IONIZATION FIRE-SIGNAL DEVICE

[76] Inventor: Hartwig Beyersdorf, Konsulweg 29, D-2409 Scharbeutz, Fed. Rep. of Germany

[21] Appl. No.: 878,803

[22] Filed: Feb. 17, 1978

[30] Foreign Application Priority Data

Feb. 21, 1977 [DE] Fed. Rep. of Germany ..... 2707409

[51] Int. Cl.[2] ..... G08B 17/10

[52] U.S. Cl. ..... 250/381; 250/385; 307/308; 307/363; 340/629

[58] Field of Search ..... 250/381, 382, 385, 389; 307/362, 363, 308; 328/1, 6; 340/578, 579, 629

[56] References Cited

U.S. PATENT DOCUMENTS

| | | | |
|---|---|---|---|
| 3,559,196 | 1/1971 | Scheidweiler | 340/629 X |
| 3,603,949 | 9/1971 | Walthard | 340/579 X |
| 3,728,706 | 4/1973 | Tipton et al. | 340/629 X |
| 3,778,800 | 12/1973 | Blackwell et al. | 340/629 X |
| 3,821,734 | 6/1974 | Herrliberg et al. | 340/629 X |
| 3,909,813 | 9/1975 | Scheidweiler et al. | 340/629 X |
| 3,952,294 | 4/1976 | Emerson et al. | 340/629 X |
| 4,037,106 | 7/1977 | Scheidweiler et al. | 250/381 |
| 4,075,487 | 2/1978 | Larsen | 340/629 X |
| 4,083,037 | 4/1978 | Larsen | 340/629 |
| 4,138,670 | 2/1979 | Schneider et al. | 340/629 X |

FOREIGN PATENT DOCUMENTS

| | | | |
|---|---|---|---|
| 2328872 | 1/1974 | Fed. Rep. of Germany | 340/629 |
| 1088976 | 10/1967 | United Kingdom | 340/629 |

*Primary Examiner*—Larry N. Anagnos

*Attorney, Agent, or Firm*—Toren, McGeady and Stanger

[57] ABSTRACT

An ionization fire-signal device with an ionized measuring chamber, a reference element connected in series with the reference chamber, an amplifier stage controlled by the electric potential of the connection point of the measuring chamber and the reference element and comprising a field effect transistor, and a signal circuit controlled by the amplifier stage and comprising another transistor. A bistable behavior of the ionization fire-signal device is achieved by a positive signal feedback from the signal circuit to the substrate of the field effect transistor.

11 Claims, 2 Drawing Figures

IONIZATION FIRE-SIGNAL DEVICE

FIELD OF THE INVENTION

The invention relates to an ionization fire-signal device, preferably for use within a fire-signal system comprising signal devices connected parallel to each other between two conductors of a D.C. signalling line connected to a signal center. More specifically, the invention relates to an ionization fire-signal device of this kind, with an ionized measuring chamber penetrable by the ambient air, a reference element in series connection with the measuring chamber between the terminals of the signal device, an amplifier stage connected between the signal device terminals and controlled by the potential at the junction of the measuring chamber and the reference element, the amplifier stage having a field-effect transistor with a separate substrate terminal and a resistor in series connection with the main current path of the field-effect transistor, and a signal circuit connected between the signal device terminals and comprising the series connection of a preferably bipolar transistor and a load resistor, the signal circuit being controlled by the voltage drop at the resistor of the amplifier stage, wherein one electrode of the measuring chamber is directly connected to one signal device terminal and wherein the amplifier stage causes the transistor of the signal circuit to become conductive when a pre-determined threshold value of the smoke content of the ambient air is passed, said transistor remaining conductive during a subsequent decrease of the smoke density below the threshold value.

BACKGROUND OF THE INVENTION

The prior foreign art (German Auslegeschrift No. 1,766,440, FIG. 6 in connection with FIG. 5) describes a fire-signal device of the above mentioned type, the emitter of the field-effect transistor of the amplifier circuit being connected to the junction of the measuring chamber and a reference chamber, and the substrate of this MOS (metal-oxide silicon) field-effect transistor being connected to a voltage divider which is connected between two capacitors charged with positive and negative voltage amplitudes respectively of the pulsating supply voltage of the signal device. It is the purpose of this circuit connection to make it possible to connect one electrode of the measuring chamber directly to one terminal of the signal device, and to avoid that one of the polarities of the supply voltage could mistakenly trigger the signal device. The resistor of the amplifier circuit with which the field-effect transistor is connected, in this case, is connected to that particular signal device terminal to which the measuring chamber is connected; the load resistor of the signal circuit, formed by two ohmic resistors, in turn is connected to that terminal of the signal device to which the reference chamber is connected.

In the known fire-signal device the bistable behaviour, i.e. the maintenance of the conductive state of the signal circuit after triggering, is achieved after the cause of the signal response has been eliminated by providing the signal circuit with an additional transistor for a positive feed-back to the bipolar transistor so that the signal circuit constitutes a bistable flip-flop. The additional transistor of the signal circuit in this case necessitates an increased construction expenditure.

There are also known from German Auslegeschrift No. 1,516,529 and from U.S. Pat. No. 3,728,706, issued Apr. 17, 1973, by W. C. Tipton, ionization fire-signal devices in which the substrate terminal of the field-effect transistor of the amplifier stage is shorted with the source electrode of this field-effect transistor, and in which the signal circuit comprises a thyristor. A thyristor, however, is sensitive to fluctuations in the supply voltage and may trigger an erroneous alarm signal when interferences cause brief voltage increases. This disadvantage is of particular gravity where the fire-signal device is installed in a customary manner within a fire-alarm system in which an important number of signal devices are connected parallel to each other between two conductors of a D.C. signalling line connected to a signal center because along such lines pronounced voltage fluctuations may occur, and it is difficult to protect the signal devices against interferences created thereby.

Other similar ionization fire-signal devices are known from German Offenlegungsschrift No. 2,328,872, and from U.S. Patent No. 3,559,196, issued Jan. 26, 1971, by A. Scheidweiler, in which the resistor of the amplifier circuit is connected to the same signal device terminal to which the reference element is connected, and where the load resistor of the signal circuit is connected to the same signal device terminal to which the measuring chamber is connected; the field-effect transistor of the amplifier circuit, however, does not have a separate substrate terminal. In this case, the terminal of the measuring chamber which faces away from the junction of the measuring chamber and the reference element, is connected with the connecting point of the transistor of the signal circuit and its load resistor so that the measuring chamber is connected only indirectly, by way of the load resistor, to the associated signal device terminal, and the transistor of the signal circuit lies parallel to the series connection of the measuring chamber and the reference element. In this manner, the series connection of the measuring chamber and the reference element is shorted when the transistor of the signal circuit becomes conductive, whereby the potential at the junction of measuring chamber and reference element, by way of a positive feed-back, is shifted beyond the particular value which corresponds to the threshold value of the smoke content of the ambient air necessary to trigger a response of the signal device, so that the signal device has a bistable behaviour. This solution has the disadvantage, however, that none of the electrodes of the measuring chamber can be directly connected to a terminal of the signal device, while it is desirable, in order to effectively shield the measuring chamber from interfering fields and in order to insure a simple maintenance of the signal device, to put the outer electrode which is usually so constructed as to be permeable by air, on a fixed potential, usually the ground potential and, for this purpose, to connect this outer electrode directly to a terminal of the signal device.

Still another ionization fire-signal device similar to the aforementioned type is known (British Pat. No. 1,088,976, FIG. 2), in which a resistor of the amplifier stage is connected to that terminal of the signal device to which the reference element is connected and in which the signal circuit, in addition to the load resistor connected to that same terminal of the signal device, is provided with the series connection of the resistive coils of an indicating device and a relay which are inserted between the main current path of the transistor of the signal circuit and that signal device terminal to which one electrode of the measuring chamber is connected. In this instance, the substrate terminal of the field-effect transistor of the amplifier stage is shorted with its source electrode, and no means are provided by which the transistor of the signal circuit may be maintained in a conductive state when the smoke content decreases below the threshold value.

SUMMARY OF THE INVENTION

It is an object of the invention to simplify the signal circuit technology of an ionization fire-signal device with a transistor comprised in the signal circuit which transistor remains conductive after a response when the smoke density falls below the threshold value.

It is a further object of the invention to provide a direct connection of one electrode of the measuring chamber to one terminal of the signal device.

According to the invention, the resistor of the amplifier stage is connected to that signal device terminal to which the reference element is connected, the load resistor of the signal circuit is connected to that signal device terminal to which one electrode of the measuring chamber is connected, and the substrate of the field-effect transistor is controlled by the potential of a terminal of the load resistor facing away from the signal device terminal to which one electrode of the measuring chamber is connected.

In the ionization fire-signal device according to the invention, the substrate of the field-effect transistor of the amplifier stage in its quiescent state in the customary manner has the potential of the source electrode of that very field-effect transistor. After a response of the signal device, however, the voltage drop occurring at the load resistor or at least at one of the components of the load resistor is utilized to supply the substrate of the field-effect transistor with a potential differing from that of its source electrode by the amount of the said voltage drop. In this manner, the field-effect transistor is maintained in a conductive state even if the smoke content of the ambient air and thus the value of the gate voltage of the field-effect transistor falls beneath that very threshold value which previously triggered the response.

DESCRIPTION OF THE PREFERRED EMBODIMENTS

Figure 1:
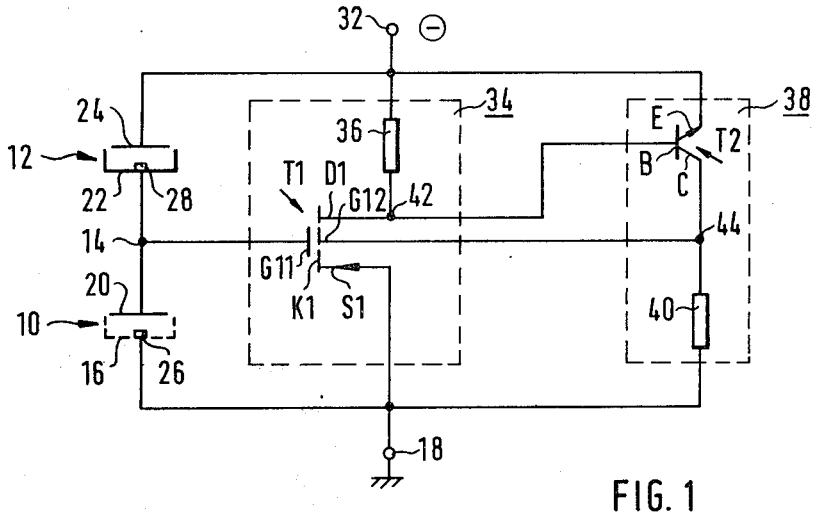
FIG. 1 shows the circuit diagram of one embodiment of the fire-signal device according to the invention.

The ionisation fire-signal device as shown in FIG. 1 has a measuring chamber 10 and a reference chamber 12 in series connection therewith. The outer electrode 16 of the measuring chamber, facing away from the point of conjunction 14 of the chambers, which outer electrode may, if so desired, also constitute the outer housing of the signal device, is directly connected with the terminal 18 of the signal device which has a ground potential. The electrode 20 of the measuring chamber 10, connected with the point of conjunction 14 as well as the electrode 22 of the reference chamber 12 connected to the point of conjunction 14, may be constructed as one unit. The ambient air, for instance may enter the measuring chamber 10 through perforations in the outer electrode 16. When smoke enters, the measuring chamber 10 presents an increased resistance compared to its quiescent state. The reference chamber 12, on the other hand, is more closely protected from the ambient air and/or whenever smoke enters, it shows a less elevated resistance. The construction locates the reference chamber 12 in the signal device axially behind the measuring chamber 10, or, alternatively, the reference chamber 12 is surrounded by the measuring chamber 10, so that the inner electrode 24 of the reference chamber 12, facing away from the point of conjunction 14, and the electrodes 20, 22 of both chambers 10, 12, connected at the point of conjunction 14, are located inside the signal device, protected from interference. In both chambers 10, 12, radioactive sources 26, 28 of minimal activity are provided, to ionize the chamber volumes so that an ionic current may flow whenever voltage is applied.

The inner electrode of the reference chamber 12, facing away from the point of conjunction 14, is connected with a terminal 32 of the signal device to which the source voltage—which in this embodiment is a negative one—is applied; this may be, as an example, 20 V.

The potential at the point of conjunction 14 controls an amplifier stage 34. In the embodiment shown this amplifier consists of a series connection of an ohmic resistor 36 and a field-effect transistor T1. It is, in this case, a MOS field-effect transistor with an insulated gate electrode G11, with a source electrode S1, with a drain electrode D1 as well as with a substrate G12 provided with a separate terminal. The substrate G12 has a similarly controlling effect as the gate G11 but it is insulated from the channel K1 of the field-effect transistor T1 by a resistive layer only. The source electrode S1 is directly connected to the terminal 18, so that the control path G11-S1 of the field-effect transistor is connected parallel to the measuring chamber 10. The resistor 36 is connected with the drain D1 on the one hand, and with that terminal 32 on the other, to which the electrode 24 of the reference chamber 12 is also connected.

The signal circuit 38 is connected operatively subsequent to the amplifier stage 34 by which it is controlled. The signal circuit 38 consists of the series connection of a bipolar transistor T2 and a load resistor 40. The base B of the transistor T2 is connected to the point of conjunction 42 of the field-effect transistor T1 and the resistor 36, while emitter E is connected directly with the terminal 32, to which the reference chamber 12 and the resistor 36 are equally connected. The load resistor 40 is inserted between the collector C of the transistor T2 on the one hand, and that terminal 18 on the other, to which the measuring chamber 10 and the field-effect transistor T1 are connected. The substrate G12 of the field-effect transistor T1 is directly connected to the point of conjunction 44 of the transistor T2 and the load resistor 40.

In its quiescent state, the potential of the point of conjunction 14, and thereby the control voltage of the field-effect transistor T1, i.e. the voltage between the point of conjunction 14 and the terminal 18, has a value at which the field-effect transistor T1 is non-conductive. The potential at the point of conjunction 42 therefore corresponds to that of the terminal 32, and the transistor T2 is also non-conductive. The potential at the point of conjunction 44, therefore, corresponds to that at the terminal 18, which means that the substrate G12 has the same potential as the source electrode S1.

When smoke enters the measuring chamber 10, the potential of the point of conjunction 14, because of the increased resistance of the measuring chamber 10, shifts in the direction of the potential of the terminal 32, i.e. the control voltage of the field-effect transistor T1 increases in magnitude. When passing beyond a threshold value of the control voltage, predetermined by the selection of the field-effect transistor T1, as well as a corresponding threshold value for the smoke concentration within the measuring chamber 10, the field-effect transistor T1 becomes markedly conductive. The current thereby flows via the resistor 36 and causes a voltage drop at this resistor, sufficient to make transistor T2 equally conductive. Because of the current now flowing through the load resistor 40, the potential at the point of conjunction 44 rises to approximately that of the terminal 32, and nearly the full supply voltage prevails between substrate G12 and the source electrode S1. Inasmuch as the substrate G12, as mentioned before, has a similarly controlling effect as the gate G11, the field-effect transistor T1 is maintained in a conductive state, whether the control voltage remains above the aforementioned threshold value or sinks to the level of the quiescence when, for instance, the smoke densitiy decreases. The signal device thus shows a bistable behavior. The conductive state of the field-effect transistor T1 and of the transistor T2 can be terminated only by lowering the supply voltage to at least approximately zero.

Depending upon the type of field-effect transistor T1 used and particularly with higher source voltages, it may be useful not to raise the voltage of the substrate G12 in relation to the source electrode S1 to the full supply voltage when the signal device responds. For this purpose, a load resistor, consisting of series-connected component resistors, may be provided instead of a single load resistor 40 and the substrate G12 may be connected to a tap of the thus created voltage divider. In any case, however, the substrate G 12 is controlled by the potential of a terminal of the load resistor, facing away from the terminal 18, or of a component resistor of this load resistor respectively.

The signal device with its terminals 32, 18, may be wired between two leads of a line leading to a signal center where it is supplied with direct voltage. In the signal center means are provided which make it possible to recognize the response of a signal device by the increased line current passing through the load resistor 40 of the responding signal device. In addition, a contact breaker will be provided in the signal center with which the line voltage may be cut off in order to re-set the signal devices that have responded.

Figure 2:
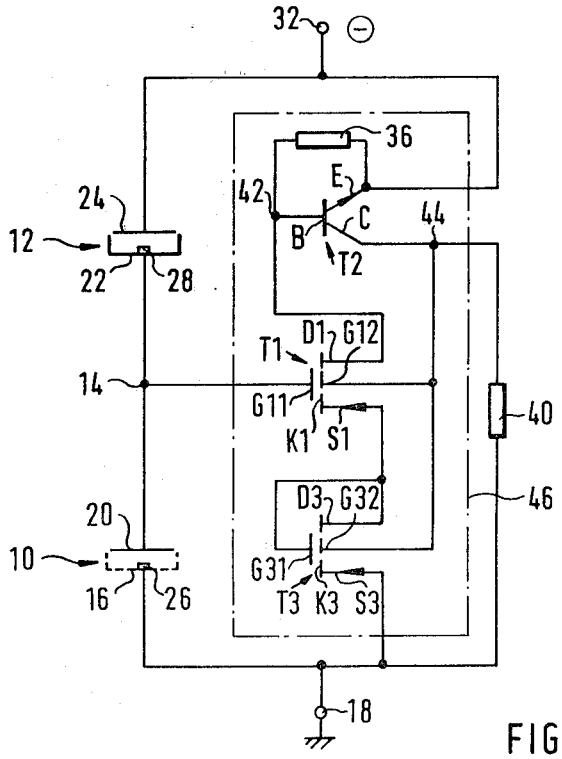
FIG. 2 shows the circuit diagramm of a further, improved embodiment of the fire-signal device according to the invention.

In FIG. 2, those parts of the signal device which correspond to the parts in FIG. 1 are given the identical reference symbols. With reference to the signal device of FIG. 2, the remarks made regarding possible modifications (the load resistor 40 formed by component resistors, resistor between substrate G12 and the point of conjunction 44) as well as regarding the use in a fire-signal system with a signal center and signal devices connected thereto by means of a line, are equally applicable.

In the signal device according to FIG. 2, the amplifier stage which is here not separately marked, in addition to the resistor 36 and the field-effect transistor T1 has a second field-effect transistor T3. This also is a MOS field-effect transistor with an insulated gate G31 as well as a substrate G32 extended as a separate terminal. The second field-effect transistor T3 with its main current path is in series connected with that of the field-effect transistor T1 and the resistor 36. The source electrode S3 of the second field-effect transistor T3 is directly connected to the terminal 18, to which the measuring chamber 10 is connected, while the drain D3 of the second field-effect transistor T3 is directly connected with the source electrode S1 of the field-effect transistor T1.

The gate G31 of the second field-effect transistor T3 is shorted with its drain D3. The substrate G32, exactly as that of the field-effect transistor T1, is connected directly to the point of conjunction 44 of the transistor T2 and the load resistor 40. It rests, therefore, in its quiescent stage, when transistor T2 is non-conductive, on the potential of the terminal 18 and thus on the potential of the source electrode S3. Because of the connection between the gate G31 and the drain D3, the additional transistor T3 in its quiescent state has the effect of an ohmic resistor; the resistance value is the reciprocal of the slope conductance.

After a response of the signal device the voltage between substrate G32 and the source electrode S3 of the second field-effect transistor T3 rises to approximately the level of the supply voltage in a manner that has been previously described for the field-effect transistor T1, in connection with FIG. 1. Thereby, the conductivity of the second field-effect transistor T3 increases markedly. As a result, both of the field-effect transistors T1, T3 are maintained conductive by means of the potential of the point of conjunction 44 as has been explained with reference to transistor T1 in connection with FIG. 1. All in all, there is, however, an increased slope conductance of the amplifier stage 36, T1, T3, as compared to FIG. 1, which means that the threshold value which triggers a response of the signal device is more precisely determined and less subject to influence by tolerances in the manufacture of the electronic elements T1, T2, T3 and to the effect of ambient temperature variations on their electrical behavior.

The signal circuit 38 (FIG. 1) is not separately rendered in FIG. 2; it consists, however, as in FIG. 1, of the series connection of the transistor T2 and the load resistor 40.

In FIG. 2 all circuit elements of the amplifier stage 34 (FIG. 1) and the transistor T2 are united by a line of dots and dashed to indicate that the field-effect transistor T1, the transistor T2, the second field-effect transistor T3, as well as, in the embodiment shown, also the resistor 36, form an integrated circuit. These circuit elements may, for instance, be in the form of an epitaxial circuit on a common chip. The manufacture of the signal device using this integrated circuit thus becomes extraordinarily simple.

Departing from the illustration shown in FIG. 2, it may be advantageous in some applications of the invention to connect the gate G31 of the second field-effect transistor T3 not directly with its drain D3, but by way of a resistor inserted between the gate G31 and the drain D3. The second field-effect transistor T3 together with the aforementioned resistor then constitutes a current limiter. In the quiescent state, the mode of operation of the amplifier stage 36, T1, T3 is practically unchanged as compared to FIG. 2; no current can flow through the second field-effect transistor T3 because the field-effect transistor T1 is not conductive. The control voltage of the field-effect transistor T1, however, is reduced in amount by this measure, i.e. the threshold value which triggers the signal device response becomes lower. With a pre-determined threshold value this means on the other hand, that a field-effect transistor T1 with a low threshold voltage is sufficient. After the signal device has responded, the current limiter has the advantageous effect that the current flowing through the series connection of the resistor 36 and the channels K1 and K3 of the field-effect transistors T1, T3, is limited to a constant, low value.

The invention, insofar as it is expressed in FIG. 2 by the control of the substrate G32 of the second field-effect transistor T3 by the potential at the terminal 44 of the load resistor 40, may also be used to advantage in such cases in which, divergent from FIG. 2, instead of the field-effect transistor T1 an alternative transistor is provided whose control electrode is connected to the point of conjunction 14 of the measuring chamber 10 and the reference chamber 12. In this case, the possibly single field-effect transistor T3 with its source electrode S1 is again connected to the signal device terminal 18 with which the outer electrode 16 of the measuring chamber is connected, and in the series connection comprising channel K3 of the field-effect transistor T3 and the resistor 36 of the amplifier stage, the main current path of the alternative input transistor is wired between channel K3 and resistor 36. Also in this case, the voltage drop at the load resistor 40 upon a signal device response and the correspondingly altered potential at the point of conjunction 44 provide a feed-back by which not only the field-effect transistor T3 but also the input transistor are maintained conductive, so that the behavior is bistable. It is in this case, however, equally preferable that the input transistor should be another field-effect transistor. In case the latter has a separate substrate terminal, it may be connected to its source electrode in the customary manner, but it has proven to be particularly advantageous if in this instance the input field-effect transistor has a terminal-free substrate. Thus, an overall circuit as in FIG. 2 results in which, however, the connection of the substrate G12 of the field-effect transistor T1 as well as the connection of this substrate G12 with the point of conjunction 44 is omitted.

In the interest of a small size and a low manufacture expediture in producing ionization fire-signal devices there is a tendency to keep the measuring chamber 10 and, if necessary, the reference chamber 12 small in volume and to use radioactive sources 26, 28 of extremely weak activity in order to keep radiation exposure of the environment to a minimum. For both of these reasons the current flowing through the series connection of the measuring chamber 10 and the reference chamber 12 has very low values. The control current of the input field-effect transistor T1 which flows, depending on the polarity of the supply voltage, from the gate G11 to the point of conjunction 14 of the measuring chamber 10 and the reference chamber 12, or in the opposite sense, should have an exactly defined value for each phase of the operation, which value is preferably small compared to the current passing through chambers 10, 12 so that temperature variations or manifestations of aging causing alterations in this control current, will not permit the occurrence of an uncontrollable falsification of the potential at the point of conjunction 14 which would alter the threshold value for a response in an undesirable manner. Giving the substrate G12 of the input transistor T1 a fixed potential, however, generally leads to an increase in the control current, which is undesirable for the reasons given above. It is therefore advisable to select a type of transistor to be used as input field-effect transistor T1 which, under the influence of the application of a fixed potential to the substrate G12 exerts little influence on the control current to or from the gate G11. In general, it may be pointed out that the input field-effect transistor T1, with its substrate G12 having a fixed potential, should have a gate current at most high as, and preferably lower, than one tenth of that current which flows through the series connection of the measuring chamber 10 and the reference element—in FIGS. 1 and 2 the reference chamber 12—in the quiescent state. The fixed potential of the substrate G12, in the quiescent state, may be the potential of the source electrode S1, or it may also be that of the drain D1 or any other potential between the aforementioned two values. A suitable type of transistor is marketed by Detectomat Gesellschaft fuer elektronische Brandmeldesysteme m.b.H., Am Hafen, D-2408 Timmendorfer Strand, Germany, with the designation D 80-52.

The exertion of a strong influence upon the control current by giving the substrate a fixed potential in its quiescent state should be avoided not only in reference to the input field-effect transistor T1, but also for the field-effect transistor T3 of FIG. 2, even where this field-effect transistor is the only field-effect transistor of the amplifier stage in case a different type of input transistor should be used. Therefore, the considerations heretofore presented for the input field-effect transistor T1 equally apply to the field effect transistor T3, and for this purpose also the type of transistor described in the paragraph above is usable to good advantage.

A further embodiment not illustrated similar to the signal devices according to FIG. 1 or FIG. 2 is based on the consideration that a low control current of the input field-effect transistor T1 is particularly important only when the smoke content of the ambient air approaches the pre-determined threshold value at which the signal device is supposed to respond so that in this instance the threshold value must be strictly adhered to, but that with virtually smoke free air a certain falsification of the potential at the point of conjunction 14 between measuring chamber 10 and reference chamber 12 by an increased control current of the field-effect transistor T1 is acceptable. Therefore the substrate G12 of the input field-effect transistor T1 in its quiescent state is given the very potential which it would assume in its unconnected state when the smoke content of the ambient air just reaches the pre-determined threshold value which is to trigger the response of the signal device. The potential of the substrate G12 in its unconnected state then approximates the threshold value of the potential at the point of conjunction 14. In order to maintain the desired potential of the substrate G12 in its quiescent state, it may be directly connected to the tap of a potential divider which in turn is connected parallel to the main current path C–E of the transistor T2 of the signal circuit T2, 40 and which may, for instance, consist of a series connection of a fixed component resistor and an adjustable component resistor. The divider ratio of this potential divider will be so chosen that in the quiescent state at its tap-in the example referred to at the point of conjunction of the two component resistors—that particular potential prevails which occurred at the substrate G12 when the said substrate G12 of the field-effect transistor T1 was not connected, and when the smoke content of the ambient air reached the pre-determined threshold value. As soon as the signal device responds, the above mentioned potential divider is shorted by the transistor T2 of the signal circuit T2, 40, and the potential at the tap of the potential divider becomes at least approximately the same as that of the signal device terminal 32 which is connected with the reference chamber 12 and which is negative in the embodiment described.

In adjusting the aforementioned potential divider which is wired parallel to the transistor T2 the procedure may be such that at first the substrate G12 of the field-effect transistor T1 is left free of connections and that, for instance, by introduction of smoke into the measuring chamber 10 the potential at the point of conjunction 14 of the measuring chamber 10 and reference chamber 12 is continuously altered until the signal device responds which means that the field-effect transistor T1 and transistor T2 of the signal circuit T2, 40 become conductive. By measuring the potential at the substrate G12 the pertinent value can be found which prevails with the pre-determined threshold value and this value is then set at the potential divider in the quiescent state, i.e. transistor T2 being non-conductive, prior to connecting the substrate G12 with the tap. As an alternative as indicated above, however, the appropriate potential prevailing at the point of conjunction 14 of the measuring chamber 10 and reference chamber 12 and thus at the gate G11 of the transistor T1 upon reaching the predetermined threshold value may be set at the quiescent potential divider because this potential then corresponds approximately to the desired potential of the substrate G12.

In a similar manner to that described above for the connection of the substrate G12 of the input field-effect transistor T1 the substrate G32 of any such field-effect transistor T3 which, with its channel K3 connected between terminal 18 and the input transistor, can be connected with the tap of a potential divider which is connected parallel to the main current path E-C of the transistor T2 of the signal circuit T2, 40. In this case also, the substrate G32 in its quiescent state is given a potential which is equal to the potential prevailing at the unconnected substrate G32 whenever the smoke content of the ambient air just about reaches its predetermined threshold value. As the signal device responds, and the transistor T2 becomes conductive, the potential divider associated with the field-effect transistor T3 is shorted and the potential of the substrate G 32 is shifted to approximately that of the signal device terminal 32, so that a strong feed-back occurs.

What is claimed is:

1. An ionization fire-signal device comprising a pair of signal device terminals, an ionized measuring chamber penetrable by the ambient air, a reference element series connected with the measuring chamber between the signal device terminals, an amplifier stage connected between the signal device terminals and controlled by the potential at the junction of the measuring chamber and the reference element, the amplifier stage including a field-effect transistor, said field-effect transistor having a separate substrate terminal and forming a main current path, said amplifier stage having a resistor in series with the main current path of the field-effect transistor, and a signal circuit connected between the signal device terminals, said signal circuit including a transistor and a load resistor connected in series with each other, the signal circuit being connected so as to be controlled by the voltage drop across the resistor of the amplifier stage, said measuring chamber having a pair of electrodes, one electrode of the measuring chamber being directly connected to one signal device terminal, the amplifier stage being connected to cause the transistor of the signal circuit to become conductive when a predetermined threshold value of the smoke content of the ambient air passes through the chamber, said transistor being connected to remain conductive during a subsequent decrease of the smoke density below the threshold value, characterized in that the resistor of the amplifier stage is connected to that signal device terminal to which the reference element is connected, that the load resistor of the signal circuit is connected to that signal device terminal to which one electrode of the measuring chamber is connected, and that the substrate of the field-effect transistor is connected so that said field-effect transistor remains conductive during said subsequent decrease of said smoke density below said threshold value.

2. An ionization fire-signal device according to claim 1 wherein the gate of the field-effect transistor is connected to the junction of the measuring chamber and the reference element.

3. An ionization fire-signal device according to claim 2 wherein the field-effect transistor forms a control path between a gate and a source and the control path of the field-effect transistor is connected directly parallel to the measuring chamber.

4. An ionization fire-signal device according to claim 1 wherein the amplifier stage has an input transistor connected with its control electrode to the junction of the measuring chamber and the reference element, the field-effect transistor having a source electrode connected to that signal device terminal to which one electrode of the measuring chamber is connected, the input transistor and the field-effect transistor each having a main current path, the main current path of the input transistor being connected between the main current path of the field-effect transistor and the resistor of the amplifier stage, the field-effect transistor having a gate and a drain, the gate being connected to its drain.

5. An ionization fire-signal device according to claim 4 wherein the field-effect transistor includes a gate and a drain, and the gate of the field-effect transistor is directly connected to its drain.

6. An ionization fire-signal device according to claim 4 wherein the input transistor is an additional field-effect transistor.

7. An ionization fire-signal device according to claim 6 wherein the load resistor has two end terminals, and the additional field-effect transistor has a separate substrate terminal, the substrate of the input transistor being coupled to the potential of the end terminal of the load resistor away from the signal device terminal which is connected to one electrode of the measuring chamber.

8. An ionization fire-signal device according to claim 4 wherein the field-effect transistor and the input transistor are components of an integrated circuit.

9. An ionization fire-signal device according to claim 1 wherein the field-effect transistor when energized and in the quiescent state, has a control current which is less than one tenth of the current flowing through the series connection of the measuring chamber and the reference element.

10. An ionization fire-signal device according to claim 1 wherein the substrate terminal of the field-effect transistor is directly connected to the terminal of the load resistor.

11. An ionization fire-signal device according to claim 1, wherein the substrate terminal is connected to the load resistor of the signal circuit, at the side thereof opposite the signal device terminal through a substantially low resistance path.

* * * * *